United States Patent [19]

Kleinophorst Geb. Schädel et al.

[11] Patent Number: 4,523,616

[45] Date of Patent: Jun. 18, 1985

[54] APPARATUS FOR CONTROLLING THE FILLING OF CONTAINERS

[76] Inventors: Edith Kleinophorst Geb. Schädel, Kronprinzenstrasse 9, 4130 Moers, 1, Fed. Rep. of Germany; Gerhard Grosskreuz, Volksdorfer Weg 174, 2000 Hamburg 65, Fed. Rep. of Germany

[21] Appl. No.: 529,825

[22] Filed: Sep. 6, 1983

[30] Foreign Application Priority Data

Sep. 7, 1982 [DE] Fed. Rep. of Germany ..... 3233093
Aug. 24, 1983 [DE] Fed. Rep. of Germany ..... 3330446

[51] Int. Cl.[3] ..... B65B 3/32

[52] U.S. Cl. ..... 141/83; 141/192; 141/242; 177/50; 222/14; 222/274; 222/485

[58] Field of Search ..... 141/250–284, 141/83, 234–248, 94, 95, 96, 192–229; 222/273, 274, 14, 485; 177/50

[56] References Cited

U.S. PATENT DOCUMENTS 2,327,124 8/1943 Morse ..... 222/274
3,633,489 1/1972 Spoelhof et al. ..... 222/485
3,834,585 9/1974 Aker ..... 222/485
3,907,167 9/1975 Zanardo ..... 222/485
3,965,860 6/1976 Cone et al. ..... 222/485
4,206,857 6/1980 Gregory et al. ..... 222/485

*Primary Examiner*—Houston S. Bell, Jr.
*Attorney, Agent, or Firm*—Beveridge, De Grandi & Weilacher

[57] ABSTRACT

In order to simultaneously fill several containers with a liquid, gaseous or solid flowable medium, without it being necessary to measure and monitor the filling volume or weight of each container, the filling apparatus has a pipe system (10) for carrying the medium to be filled. The pipe system includes a plurality of branch lines (13, 113, 213) leading to valves (20, 120, 220). In the branch lines there are arranged volume chambers (40, 140, 240) having impellers jointly placed on a shaft (41) with a system pressure-dependent braking device (45). The impellers are rotated by the medium flowing through the volume chambers. A balance (50) or a rotary piston meter (150) is associated with only one valve (20) of all the valves controlled by a control cylinder (25) and is used for controlling the latter.

6 Claims, 2 Drawing Figures

APPARATUS FOR CONTROLLING THE FILLING OF CONTAINERS

BACKGROUND OF THE INVENTION

The invention relates to an apparatus for the simultaneous filling of a liquid, gaseous or solid flowable medium into several containers, such as tanks, drums, packs, etc., comprising a pipe system with a feed pump for supplying the medium and with valves connected by supply lines for the containers.

Known systems for the filling of liquid, gaseous or flowable material are constructed in such a way that, even in the case of simultaneous filling of several containers, the quantity of material necessary for each container is individually set. Consequently, such a filling system requires a number of devices corresponding to the number of individual containers, enabling the volume or weight of each container to be measured and monitored.

U.S. Pat. No. 3,548,891 discloses an installation for the simultaneous filling of several containers, but using metering and filling devices in a number corresponding to the number of containers, an individual device being associated with each container. The pipe connections of the devices permit the filling of individual coontainers in accordance with the volume. However, in this installation, the volume or weight of each single container is not measured and monitored, and thus the filling of all the containers is controlled on the basis of the monitoring of a single container.

U.S. Pat. No. 3,205,920 relates to a mechanism in which the association of a volume chamber and the coupling of the valve operation are provided.

In the apparatus according to Swiss Pat. No. 174,324, a weight-dependent control member is provided, which functions in such a way that the further supply of the medium is interrupted when the weight that has been predetermined for each container is reached. However, this apparatus does not provide for the control of a plurality of valves by means of a single weight-controlled device.

The present invention solves the problem of providing a calibratable system, with which several containers can be simultaneously filled and in which only the volume or weight of a single container need be measured and monitored. Thus a simple, economic system is obtained, whose working capacity can be increased in a simple manner at any time, without involving great technical effort and expenditure.

The invention also solves the problem of providing a calibratable system enabling several containers to be simultaneously filled, it only being necessary to measure the volume or weight of one container which can be used for controlling the inflow of further medium, so as to control the volume or weight for the other containers by means of comparative measurements of flow quantities, so that a simple, economic system with a high working capacity is obtained, without involving great technical expenditure and effort. It is merely necessary to compare the flow rates to the individual containers with a stored desired value and on the basis thereof to carry out the control of the further medium inflow quantity. This system can be housed in several zones, if a single available zone is unable to receive the complete apparatus with the numerous emptying stations.

SUMMARY OF THE INVENTION

According to the invention, this problem is solved by an apparatus constructed in such a way that each of the supply lines leading to the valves contains a volume chamber with an impeller arranged in its interior which is rotated by the medium flowing to the particular valve. The impellers of all the volume chambers are rigidly interconnected by means of a mechanical shaft, which is connected to a braking device controllable by means of a system pressure-dependent control device. A two-stage, pneumatic control cylinder is provided for controlling the valves and is connected directly to at least one valve and is connected to the remaining valves by means of an adjusting device. A control element, responding to the weight of the medium via a balance associated with one of the valves, is provided and is connected to the control cylinder.

Such a construction provides a calibratable mechanism enabling several containers to be simultaneously filled, it being necessary to only measure and monitor the volume or weight of one container. This ensures that the remaining containers, not monitored by a balance or a rotary piston meter, are also filled with the desired weight or volume of the medium within the scope of the permitted tolerances. This is achieved in that the impellers of the volume chambers are driven centrally by a shaft through the medium flowing to the valve. By means of a system pressure-dependent braking device, the rotational speed of the shaft interconnecting the impellers of the volume chambers is controlled in such a way that the same pressure conditions prevail in all these chambers, so that the medium is supplied with the same pressure to the valves. The valves are controlled through the use of a single balance or rotary piston meter as the control device. All the valves are simultaneously opened and closed. The closing of the valves takes place simultaneously on reaching the desired weight given on the balance.

The thus constructed apparatus has the following advantages. Only one container is weighed or volumetrically monitored by means of a rotary piston meter. The filling tolerance of all the other valves is only dependent on the precision of the mechanically coupled volume chambers. As the precision of the mechanically coupled volume chambers is very great, the filling tolerances scarcely influence the final weight. An existing installation can at any time be extended without great technical expenditure. Pressure waves and fluctuations in the pipe system of the installation have no influence on the filling tolerance. Through the coupling of the volume chambers by means of a rigid shaft and through the synchronous operation of the valves by a control mechanism, the calibratability condition is achieved.

The invention also provides an apparatus for the simultaneous filling of a liquid, gaseous or solid flowable medium into several containers, such as tanks, drums, packs, etc., which comprises (a) a pipe system with a feed pump for the supply of the medium, (b) at least two valves connected to the pipe system via supply lines, (c) a volume chamber arranged in each supply line and connected upstream of the valves with an impeller which has a shaft and which is rotated by the medium flowing to the valve, (d) a control element responding to the weight of the medium via a balance associated with one of the valves, the control element being connected with a two-stage control cylinder which is directly connected to the valve, (e) pneumatic two-stage control cylinders connected to the valves, and (f) flow recorders connected to the volume chambers, whereby the flow recorder of the volume chamber with the valve controlled by the balance is connected to a device which stores as a desired value the through-flowing medium quantity determined by that flow recorder, whereby in said device the outputs of the flow recorders of the other volume chambers are applied and in which the desired value from the first flow recorder is compared with the actual values from the other flow recorders, and on reaching the desired values for the other volume chambers the valves associated therewith are disconnected.

As a result of such a construction, a calibratable filling system is obtained enabling several containers to be filled simultaneously whilst it is only necessary to measure or monitor the volume or weight of a single container and store the flow quantity of a single container controlled by the balance. The thus obtained desired value is compared with the recorded and stored flow values for the remaining stations for the other containers. By means of these comparative measurements, the control of the further inflow or the disconnection of the supply of medium to the further filling stations and containers is controlled. It is thereby ensured that the remaining containers, not monitored by a balance or rotary piston meter, are also filled with the desired weight or volume of the medium within the smallest tolerances. This is achieved in that by means of a single balance, only one of the valves is closed via a control element. The medium quantity flowing through the volume chamber to this closed valve is maintained until the valve in the associated flow recorder is closed and the flow value obtained in this way is fed as a desired value into the store.

The store is simultaneously supplied with the flow values obtained by the flow recorders of the other volume chambers. The store then compares the actual values determined by the flow recorders with the stored or desired flow value of that particular flow recorder whose associated valve is controlled by the balance. If the actual values of the other flow recorders correspond to the desired value, the remaining valves are closed, so that the same quantity of medium is contained in all the containers. As the value comparison in the store takes place in a very short time and consequently no delay results, it is ensured that on closing the valves, the same quantity of medium is contained in all the containers. This comparative measurement in the store ensures that in those stations where the predetermined desired weight has not been reached in the container to be filled, filling material flows in until the desired weight is reached and only then is the associated valve closed.

Such a filling installation leads to the following advantages. Only a single container is weighed or volumetrically monitored by a rotary piston meter, the flow quantity being stored as a desired value by the associated volume chamber. The filling tolerance of all the further valves is solely dependent on the speed of the comparative measurements of the flow values in the store for the remaining filling stations. If the desired value is not reached, the deficient quantity of filling material flows in until this value is reached and only then are the valves of the corresponding chambers closed. The precision based on the comparative measurements of the flow values and the control by means of these measurements is very high. Due to the fact that the valves of the stations not connected to the balance are separately controlled by the store, it is ensured that no final weight-influencing filling tolerances are generated, so that all the containers have the same filling quantities or weights. Due to the fact that the volume chambers are no longer interconnected, it is possible to house individual volume chambers or groups thereof with their valves in separate zones or rooms, if the existing area is not adequate for housing the complete installation. Pressure waves and fluctuations in the pipe system have no influence on the filling tolerance, and account is taken thereof by the comparative measurements in the store.

Further advantageous developments of the invention can be gathered from the following description.

BRIEF DESCRIPTION OF THE DRAWINGS

The invention is described in greater detail hereinafter relative to the drawings, in which.

DETAILED DESCRIPTION OF THE INVENTION

Figure 1:
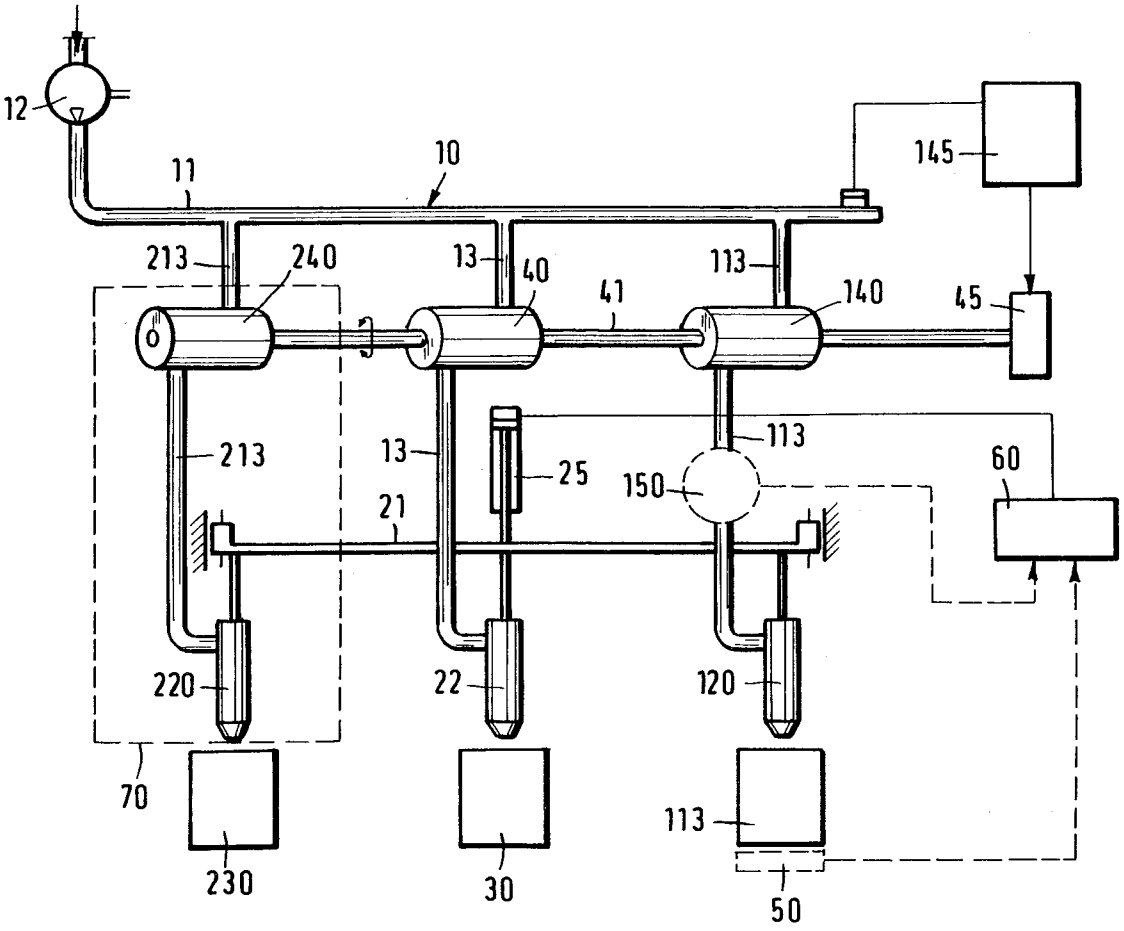
FIG. 1 is a diagrammatic view of a filling apparatus for the simultaneous filling of a medium into several containers, with volume chambers whose impellers are interconnected by means of a control shaft controlled by a balance.

The filling apparatus according to FIG. 1 comprises a pipe system 10, including a main supply line 11 for the medium, a feed pump 12, and a plurality of further supply lines 13, 113, 213 which branch from the main supply line 11 and which lead to a corresponding number of valves 20, 120, 220. The number of valves can be set at random and is dependent on the size of the apparatus and the number of containers to be simultaneously filled. In the case of the embodiment of the apparatus shown in FIG. 1, there are three valves. On operating the valves 20, 120, 220, which are constructed in per se known manner, the operation, i.e., the opening, adjusting and closing takes place by means of a control mechanism 121, which is connected to the valves 20, 120, 220 and which is controlled by a two-stage pneumatic control cylinder 25.

A container 30, 130, 230 to be filled is associated with each valve 20, 120, 220. These containers are tanks, drums, packs, etc., there being no limitations regarding the dimensions of the container to be filled. In place of the containers, it is also possible to simultaneously fill in the same way the load compartments of trucks, freighters, etc.

A volume chamber 40, 140, 240 is connected upstream of each of the valves 20, 120, 220 and is arranged in the supply lines 13, 113, 213 which branch off from the main supply line 11 and which lead to the valves 20, 120, 220. The inner area of each volume chamber 40, 140, 240 contains an impeller (not shown) which is mounted in rotary manner in the volume chamber and which is rotated by the medium flowing to the valve. The impellers of all the volume chambers 40, 140, 240 are fixed together by means of a mechanical shaft 41, which is connected to a braking device 45, which is controlled by means of a system pressure-dependent control mechanism 145. The rotational speed of the impellers in volume chambers 40, 140, 240 is predetermined so that the same pressure conditions prevail in all these chambers.

The bearing shafts of the impellers of volume chambers 40, 140, 240 can be interconnected by means of plug connections to shaft 41, so that the possibility exists of enlarging an existing installation having a certain number of volume chambers with valves. To this end, each valve, together with the volume chamber associated therewith, is constructed as a standard component 70, so that it is merely necessary to connect the volume chambers to the main supply line 11 of the existing pipe system 10, as well as the connection to the control mechanism 21.

A balance 50, constructed in per se known manner, is associated with one of the emptying valves 20, 120, 220 of the apparatus. In the embodiment shown in the drawing, the balance 50 is arranged below valve 120. Balance 50 is connected to a control element 60, which permits the control of control cylinder 25. According to another embodiment, it is possible to replace balance 50 by a rotary piston meter 150 which is in the connecting line between volume chamber 140 and valve 120 and which is connected to control element 60 in the same way as balance 50.

The apparatus according to FIG. 1 functions as follows. The medium to be filled is fed by means of feed pump 12 through pipe system 10 to valves 20, 120, 220. The medium flows out of the valves into the containers positioned below them. In front of each valve 20, 120, 220, the medium flows through the volume chambers 40, 140, 240, which are connected upstream of the valves and whose impellers are rotated by the flowing medium.

Due to the fact that the impellers of the volume chambers 40, 140, 240 associated with valve 20, 120, 220 are interconnected by shaft 41, it is ensured that the same quantity of medium is supplied to each valve, within the scope of the precision of the impellers. By means of the two-stage pneumatic control cylinder 25, valves 20, 120, 220 are adjusted to coarse and fine volume and are also opened and closed. The precise synchronization during opening, adjusting and closing the valves 20, 120, 220 is produced by the control device 21 between control cylinder 25 and the valves.

The control of the pneumatic control cylinder 25 takes place by means of the control mechanism 60, which either responds to the weight of the medium via balance 50, or to the volume via the rotary piston meter 150.

Optionally, and if necessary, a braking device 45 can be provided for controlling the system pressure on mechanical shaft 41, which connects the impellers of volume chambers 40, 140, 240. The brake torque is regulated by means of the control mechanism 145 in accordance with the optimum system pressure.

The filling apparatus is suitable for the filling of liquid, gaseous or flowable solid materials.

According to another embodiment of the invention, the rotational speed of shaft 41, and of the impellers of volume chambers 40, 140, 240 connected thereto, is controlled not by means of the braking device 45, but by means of a regulatable electric motor (not shown). This regulating motor can also be pole-reversable.

The flowing medium is switched from coarse supply to fine supply by balance 50 or by the rotary piston meter 150 by means of the control cylinder controlled by control member 60. This switching from coarse supply to fine supply is achieved at a predetermined weight, so that on reaching this weight or volume, medium is supplied via the fine supply until the desired weight is reached.

Figure 2:
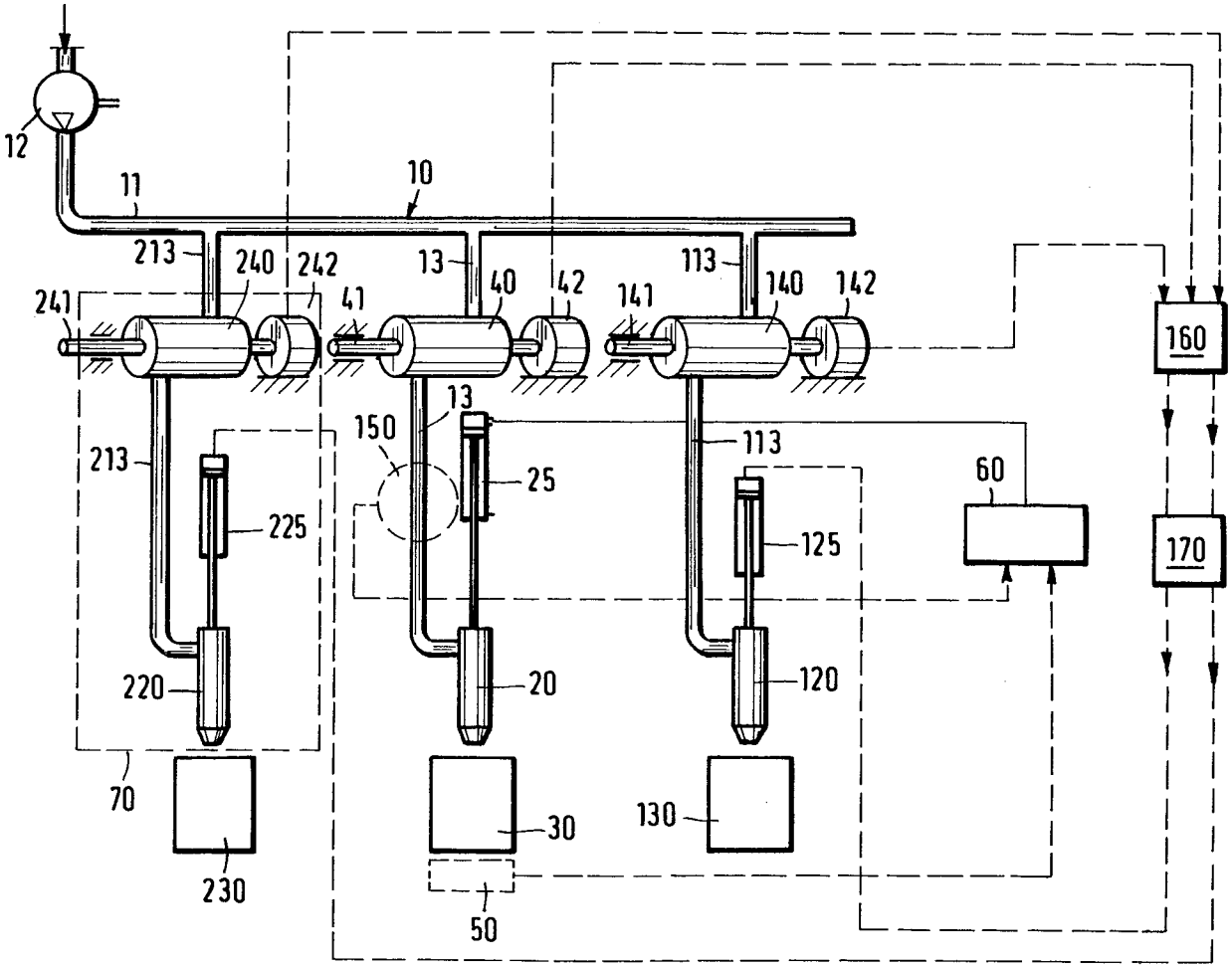
FIG. 2 is a diagrammatic representation of another embodiment of a filling apparatus with control of the stations by means of the flow quantities in the volume chambers in conjunction with a balance.

The filling apparatus according to FIG. 2 is constructed roughly the same as that of FIG. 1. The apparatus once again comprises a pipe system 10, including a main supply line 11 for the medium, a feed pump 12, and a plurality of supply lines 13, 113, 213 which branch off from the main supply line 11 and which lead to the corresponding number of valves 20, 120, 220. The number of valves can be selected at random and depends on the size of the apparatus and the number of containers to be simultaneously filled. In the embodiments shown in the drawing, there are three valves.

The operation of the valves 20, 120, 220, which are constructed in per se known manner, i.e. the opening, adjusting and closing, takes place by means of pneumatic control cylinders 25, 125, 225, which advantageously operate in a two-stage manner. However, it is also possible to provide differently constructed control mechanisms and drive mechanisms for operating valves 20, 120, 220.

A container 30, 130, 230 is associated with each valve 20, 120, 220. These containers are tanks, drums, packs, etc., there being no limitations with regards to the dimensions of the containers to be filled. The containers can be replaced by the load compartments of trucks, freighters, etc., which can be simultaneously filled in the same way.

A volume chamber 40, 140, 240 is connected upstream of each valve 20, 120, 220 and is arranged in the supply lines 13, 113, 213, which branch off the main supply line 11 and which lead to the valves 20, 120, 220. Within each volume chamber 40, 140, 240, is an impeller (not shown) which is rotatably mounted in the chamber by means of bearing shafts 41, 141, 241 and which is rotated by the medium flowing to the valve. The impellers of all the volume chambers 40, 140, 240 are correspondingly mounted by means of their bearing shafts 41, 141, 241.

Each bearing shaft 41, 141, 241 of each impeller of each volume chamber 40, 140, 240 is connected to a flow recorder 42, 142, or 242. These flow recorders 42, 142, 242 determine the quantity of media flowing through the volume chambers 40, 140, 240, specifically by means of the rotational speed or the number of rotations of bearing shafts 41, 141, 241 of the individual impellers. Due to the fact that the volume of each volume chamber is fixed, and all volume chambers 40, 140, 240 have the same volumes, it is possible, by means of bearing shafts 41, 141, 241, to determine and record the medium quantities flowing through the individual volume chambers.

Each valve, and the volume chamber associated with it, is constructed as a standard unit 70', so that it is merely necessary to have a connection of the volume chamber to the main supply line 11 of the existing pipe system 10, in order to extend existing plants to new requirements.

A known type of balance 50 is associated with one of the valves 20, 120, 220 of the apparatus. In the case of the embodiment of FIG. 2, the balance 50 is positioned below valve 20. The balance 50 is connected to a control element 60, by means of which it is possible to control control cylinder 25. According to a further embodiment, it is possible to replace balance 50 by rotary piston meter 150 which is arranged in the connecting line between the volume chamber and the valve and which is connected to control element 60 in the same way as balance 50. The control of the control cylinder 25 for switching on and off of the valve 20, which is associated with drum 30, takes place by means of balance 50 and control element 60. However, it is possible to control one of the other valves 120 or 220 by means of balance 50.

The flow recorders 42, 142, 242 connected to volume chambers 40, 140, 240 are used for determining the quantities of media which have flowed through the volume chambers. All three flow recorders 42, 142, 242 are connected to a means 160 storing the flow quantity values as determined by the recorders. The overall arrangement is such that the flow value determined by flow recorder 42 is fed into store 160 as a desired value. The flow values determined by flow recorders 142, 242 are also fed into store 160 as actual values and are compared with the stored flow value (desired value) of flow recorder 42. Store 160 can simultaneously perform control functions if no separate control element 170 is provided. This control function consists of disconnecting valves 120, 220 by means of control cylinders 125, 225 if the volume chambers 140, 240 have reched their desired values, which must coincide with the stored desired value of flow recorder 42. Therefore, the control cylinders 125, 225 are connected to the control element 170 or the control part of store 160.

The filling apparatus according to FIG. 2 functions as follows. The medium to be filled is fed by means of feed pump 12 through pipe system 10 to valves 20, 120, 220, which are in the open position. The medium flows from the valves into the container 30, 130, 230 positioned below. On the way to the valves 20, 120, 220, the medium flows through the volume chambers 40, 140 or 240 each of which is positioned upstream of it associated valve and has its impeller rotated by the flowing medium. The quantities flowing through the volume chambers are determined by the flow recorders 42, 142, 242 and the values obtained, to which further reference will be made hereinafter, are fed into store 160. It is possible through pressure fluctuations and waves in the pipe system that the valves 20, 120, 220 supply different quantities or volumes of medium to the containers 30, 130, 230. However, in order to have the same quantities or volumes of the medium in all the containers 30, 130, 230, on reaching a predetermined weight balance 50, by means of control elements 60, brings about a closing of the valve 20 via the control cylinder 25. Simultaneously, the quantity of medium which has flowed through the volume chamber 40 is determined and the flow value is recorded in the flow recorder 42 and is fed as a desired value to store 160. The values of the medium quantities which have flowed through volume chambers 140, 240 and been recorded by flow recorders 142, 242 are fed into store 160 as actual values. By means of per se known mechanisms, within store 160 the actual values of flow recorders 142, 242 are compared with the desired value of flow recorder 42, and when the actual values of flow recorders 142, 242 reach the desired value of flow recorder 42, the two control cylinders 125, 225 of valves 120, 220 are closed. Thus, no further medium can flow into container 130, 230.

It is possible in this way, by means of a flow quantity value taken from the volume chamber 40 and serving as a desired value, to control the quantity through the other volume chambers 140, 240 and to close their emptying valves 120, 220 at the time at which the medium quantity already determined by flow recorder 42 has flowed through volume chambers 140, 240.

If, for example, all three containers 30, 130, 230 are to be filled with 50 kilograms of medium, then before reaching a weight of 50 kg, e.g. at 48 kg, the valve 20 in container 30 is closed by balance 50 via control element 60. The flow quantity of 48 kg determined by the flow recorder 42 is fed into store 160 as a desired value, flow recorder 42 taking account of the difference occurring over the path from volume chamber 40 to valve 20. If the flow quantities determined by flow recorders 142, 242 differ from the 48 kg value or desired value fed into the store 160, the two valves 120, 220 for containers 130, 230, controlled by control element 170, remain open until the flow quantities in volume chambers 140, 240 have reached the desired value in store 160. If the flow values of flow recorders 142, 242 are below the desired value in store 160, then by means of the open valves 120, 220 medium flows into containers 130, 230 until the desired value is reached. The flow recorders 142, 242 in each case determine the new actual values and supply these to store 160, in which the varying actual values are compared. Control element 170 then brings about the closing of valves 120, 220 if the actual values of flow recorders 142, 242 have reached the stored desired value of flow recorder 42.

Advantageously, balance 50 is set in such a way that the closing of valve 40 takes place before the predetermined desired weight value of the balance has been reached. This ensures that the same quantity is provided each container even if, through volume chambers 140, 240, a larger medium quantity flows to the valves 120, 220 and reaches containers 130, 230, which are above the predetermined desired weight value of balance 50.

The apparatus according to FIG. 2 is also suitable for filling liquid, gaseous or flowable solids substances.

By means of balance 50 or rotary piston meter 150 and via control cylinder 25 controlled by control element 60, there is a switchover from coarse supply to fine supply of the medium to be filled. This is achieved by a desired weight (e.g. 48 kg) predetermined in the balance, so that on reaching this desired weight or volume sufficient medium is supplied by means of the fine supply until the predetermined desired weight (e.g. 50 kg) is detected by balance 50 and valve 20 is closed. The flow recorder 42 now determines the desired volume value corresponding to the desired weight, and this is fed into store 160. If the flow quantities of flow recorders 142, 242 are below the desired weight in store 160, then by means of the open valves 120, 220 medium flows into containers 130, 230 until the desired volume value, and consequently the desired weight value of 50 kg, is reached, and consequently all the containers 30, 130, 230 are filled with 50 kg of medium. By means of a corresponding preselection of the changeover point from coarse supply to fine supply, control cylinders 125, 225, also being constructed in such a way that they can also control coarse and fine supply, it is possible to prevent overfilling of individual containers beyond the desired weight or volume.

We claim:

1. Apparatus for the simultaneous filling of a flowable medium into a plurality of containers, such as tanks, drums, or packs, comprising a main pipe line, a feed pump in the main pipe line for supplying the medium, a plurality of branch supply lines each having one end coupled to the main pipe line, a plurality of valves, one valve in each of the branch supply lines, a plurality of volume chambers, one volume chamber in each branch supply line, each volume chamber having an impeller arranged in its interior to be rotated by the medium flowing therethrough, a mechanical shaft rigidly interconnecting the impellers of all the volume chambers, a braking device for the mechanical shaft, a system pressure-dependent control device for controlling the braking device, a two-stage, pneumatic control cylinder for controlling the valves, an adjusting device directly connecting the pneumatic control cylinder to the valves, means associated with one of the valves for determining the amount of the medium passing therethrough, and a control element coupled to the last-named means and responding to the determined amount of the medium for controlling the control cylinder.

2. Apparatus for the simultaneous filling of a medium into several containers, such as tanks, drums, or packs, comprising:

(a) a main pipe line, (b) a feed pump in the main pipe line for supplying the medium therethrough, (c) at least two branch supply lines each having one end connected to the main pipe line for receipt of the medium therefrom, (d) at least two valves, one valve in each branch supply line, (e) at least two volume chambers, one volume chamber arranged in each branch supply line upstream of the valve, with an impeller with a bearing shaft arranged in the interior of each volume chamber to be rotated by the medium flowing therethrough to the valve, (f) means associated with one of the valves for determining the amount of the medium passing therethrough, (g) a two-stage control cylinder directly connected to said one of the valves, (h) a control element coupled to the last-named means and to the two-stage control cylinder and responding to the determined amount of the medium for controlling the two-stage control cylinder to control said one of the valves, (i) at least one pneumatic two-stage control cylinder, each pneumatic two-stage control cylinder connected to one of the remaining ones of the valves, (j) a plurality of flow recorders, one flow recorder connected to each of the volume chambers, (k) a flow data storage device, (l) means connecting the flow recorder of the volume chamber having the valve controlled by the determining means to the flow data storage device for storage, as a desired value, of the throughflowing medium quantity described by the last-named flow recorder, (m) means connecting the flow data storage device of the other volume chambers for comparison of the desired value with the actual values of the other flow recorders, and (n) means responsive to such comparison for controlling the other values so that on reaching the desired values for the volume chambers, the valves associated therewith are disconnected.

3. Apparatus according to claim 1 or claim 2 in which the means for determining the amount of the medium comprises a balance.

4. Apparatus according to claim 1 or claim 2 further comprising a regulatable electric motor for driving the impeller of each volume chamber.

5. Apparatus according to claim 1 or claim 2 in which each volume chamber and the valve associated therewith is constructed as a standard unit permitting extension of an existing apparatus.

6. Apparatus according to claim 1 or claim 2 in which the means for determining the amount of the medium comprises a rotary piston meter.

* * * * *